US008985489B2

(12) United States Patent
Jara-Almonte et al.

(10) Patent No.: US 8,985,489 B2
(45) Date of Patent: Mar. 24, 2015

(54) FOOD WASTE DISPOSER WITH FOOD DEFLECTING HOUSING

(75) Inventors: Cynthia C. Jara-Almonte, Kenosha, WI (US); Donald Gapko, Racine, WI (US); Randall E. Hammer, Muskego, WI (US); Dane Hofmeister, Racine, WI (US)

(73) Assignee: Emerson Electric Co., St. Louis, MO (US)

( * ) Notice: Subject to any disclaimer, the term of this patent is extended or adjusted under 35 U.S.C. 154(b) by 418 days.

(21) Appl. No.: 13/542,758

(22) Filed: Jul. 6, 2012

(65) Prior Publication Data

US 2013/0175375 A1 Jul. 11, 2013

Related U.S. Application Data

(60) Provisional application No. 61/505,558, filed on Jul. 8, 2011.

(51) Int. Cl.
*B02C 23/36* (2006.01)
*E03C 1/266* (2006.01)

(52) U.S. Cl.
CPC ..... *E03C 1/2665* (2013.01)
USPC ..... 241/46.016; 241/46.014

(58) Field of Classification Search
USPC ..... 241/46.013, 16.014, 46.016
See application file for complete search history.

(56) References Cited

U.S. PATENT DOCUMENTS

| | | | | |
|---|---|---|---|---|
| 2,879,949 | A | 3/1959 | Jordan | |
| 3,013,736 | A * | 12/1961 | Pontis | 241/46.013 |
| 3,025,007 | A | 3/1962 | Wieczorek | |
| 3,188,012 | A * | 6/1965 | Shive et al. | 241/46.013 |
| 3,236,462 | A | 2/1966 | Stout | |
| 3,455,518 | A | 7/1969 | Chambers et al. | |
| 3,464,368 | A | 9/1969 | Wicke | |
| 3,875,462 | A * | 4/1975 | Kiefer et al. | 241/36 |
| 6,007,006 | A | 12/1999 | Engel et al. | |
| 7,048,213 | B2 * | 5/2006 | Strutz et al. | 241/36 |
| 7,360,729 | B2 | 4/2008 | Anderson et al. | |
| 7,607,599 | B2 | 10/2009 | Jara-Almonte et al. | |
| 8,220,731 | B2 * | 7/2012 | Berger et al. | 241/46.013 |
| 2004/0256506 | A1 * | 12/2004 | Berger | 241/46.013 |

OTHER PUBLICATIONS

International Search Report and Written Opinion of the International Searching Authority for PCT/US2012/045659 mailed Oct. 22, 2012.

* cited by examiner

*Primary Examiner* — Faye Francis
(74) *Attorney, Agent, or Firm* — Harness, Dickey & Pierce, P.L.C.

(57) ABSTRACT

A food waste disposer has a food conveying section that receives food waste and water; a grinding section including a grinding mechanism, and a motor section including a motor. The grinding section is disposed between the food conveying section and the motor section. The grinding mechanism includes a stationary grind ring and a rotating shredder plate assembly that rotates in the grind ring to grind food waste to form ground matter that combines with the water to form a slurry. The slurry passes into a discharge area in an upper end bell below the shredder plate assembly. The food conveying section includes a housing having a food waste deflecting band with an angular profile at a lower end of the housing.

14 Claims, 6 Drawing Sheets

FOOD WASTE DISPOSER WITH FOOD DEFLECTING HOUSING

CROSS-REFERENCE TO RELATED APPLICATIONS

This application claims the benefit of U.S. Provisional Application No. 61/505,558, filed on Jul. 8, 2011. The entire disclosure of the above application is incorporated herein by reference.

FIELD

The present disclosure relates generally to food waste disposers, and more particularly, to a food waste disposer having a food deflecting housing.

Food waste disposers are used to comminute food scraps into particles small enough to safely pass through household drain plumbing. A conventional food waste disposer of the type for under sink mounting that is mounted to a sink, such as a kitchen sink, includes a food conveying section, a motor section, and a central grinding section disposed between the food conveying section and the motor section. The food conveying section includes a housing that forms an inlet for receiving food waste and water. The food conveying section conveys the food waste to the grinding section, and the motor section includes a motor imparting rotational movement to a motor shaft to operate the grinding mechanism.

The grinding section in which comminution occurs typically has a rotating shredder plate with lugs and a stationary grind ring received in a housing of the grinding section. The motor turns the rotating shredder plate and the lugs force the food waste against the grind ring where it is broken down into small pieces. Once the particles are small enough to pass out of the grinding mechanism, they are flushed out into the household plumbing. Size control is primarily achieved through controlling the size of the gap through which the food particles must pass. In some cases, the housing of the grinding section and the housing of the food conveying section are integrally formed as a single housing. In other cases, they are not. Such a prior art food waste disposer is disclosed in U.S. Pat. No. 6,007,006, which is incorporated herein by reference in its entirety. The food waste disposer may be mounted in a well-known manner in the drain opening of a sink using mounting members of the type disclosed in U.S. Pat. No. 3,025,007, which is incorporated herein by reference in its entirety.

FIG. 1 depicts a prior art food waste disposer 100 which is similar to the prior art food waste disposer described in U.S. Pat. No. 7,360,729 and U.S. Pat. No. 7,360,729 is incorporated by reference herein in its entirety. The disposer includes an upper food conveying section 102, a central grinding section 104 and a motor section 106, which may include a variable speed motor. It should be understood that motor section 106 could also include a fixed speed motor, such as an induction motor. The grinding section 104 is disposed between the food conveying section 102 and the motor section 106.

The food conveying section 102 conveys the food waste to the grinding section 104. The food conveying section 102 includes an inlet housing 108 and a conveying housing 110. The inlet housing 108 has an inlet 109 at the upper end of the food waste disposer 100 for receiving food waste and water. Inlet 109 is surrounded by a gasket 111. The inlet housing 108 is attached to the conveying housing 110, such as by an antivibration mount 113.

The conveying housing 110 has an opening 142 to receive a dishwasher inlet 144. The dishwasher inlet is used to pass water from a dishwasher (not shown). The inlet housing 108 and conveying housing 110 may be made of metal or molded plastic. Alternatively, inlet housing 108 and conveying housing 110 may be one unitary piece.

The grinding section 104 includes a housing 112 surrounding a grinding mechanism 114 having a rotating shredder plate assembly 116 and a stationary grind ring 118. Housing 112 is formed as a clamp ring and clamps conveying housing 110 to an upper end bell 136 of motor section 106. Stationary grind ring 118, which includes a plurality of spaced teeth 120 (only two of which are indicated by reference number 120 in FIG. 1), may be received in an adaptor ring 122 disposed between housing 112 and stationary grind ring 118. A gasket 123 is disposed between adaptor ring 122 and an upper portion 125 of housing 112. A bottom flange 127 of conveying housing 110 is received in gasket 123 and gasket 123 seals inlet housing 110 to adaptor ring 122.

The shredder plate assembly 116 may include a rotating shredder plate 124 mounted to a rotatable shaft 126 of a motor 128 of motor section 106, such as by a bolt 130. Motor 128 also includes a rotor 129 to which rotatable shaft 126 is affixed and a stator 131. A plurality of fixed lugs 132 (only one of which is shown in FIG. 1) are mounted on rotating shredder plate 124 as are a plurality of swivel lugs 134 (only one of which is shown in FIG. 1). It should be understood that in this regard, rotating shredder plate assembly 116 could include only fixed lugs 132 or only swivel lugs 134.

Motor section 106 includes an upper end bell 136 affixed to a bottom 138 of grinding section 104. Upper end bell 136 includes a discharge chamber 140 having a discharge outlet 141 for coupling to a tailpipe or drainpipe (not shown).

In an aspect, food waste disposer 100 may include a trim shell 146 that surrounds food conveying section 102, grinding section 104 and motor section 106. A layer of sound insulation 148 may be disposed between trim shell 146 and conveying housing 110 of food conveying section 102 and housing 112 of grinding section 104.

In the operation of the food waste disposer 100, the food waste delivered by the food conveying section 102 to the grinding section 104 is forced by lugs 132, 134 of the rotating shredder plate assembly 116 against teeth 120 of the stationary grind ring 118. The sharp edges of the teeth 120 grind or comminute the food waste into particulate matter that combines with water, such as water that entered the food waste disposer through inlet 109, to form a slurry that drops into discharge chamber 140. This slurry is then discharged through the discharge outlet (not shown) into the tailpipe or drainpipe (not shown).

The food conveying section 102 (which includes inlet housing 108 and conveying housing 110) serves as the conduit for the food waste from the drain opening of the sink to the grinding mechanism of the grinding section. In a food waste disposer that operates in a batch feed mode, the amount of food waste that can be ground at a time is dictated by the volume of the food conveying section, mainly the conveying housing 110.

As discussed, conveying housings such as conveying housing 110 can be made of different materials. The most common are a molded reinforced polymer such as glass filled polypropylene, or stainless steel. The advantages of stainless steel are higher durability and higher perceived consumer value. The primary disadvantage of stainless steel compared to a polymer is that is more difficult to form complex shapes of stainless steel compared to a polymer.

The shape of the conveying housing 110 has an influence on the performance of the grinding mechanism. It is known in the art that a conveying housing with a conical or curved wall will redirect food waste expelled upwardly by the grinding mechanism back into the grinding mechanism more quickly than a housing with a straight wall. It is relatively easy to form a conveying housing having a conical or curved wall if molding a polymer to form the conveying housing. It is more difficult to do so if forming the conveying housing from stainless steel.

Typically, conveying housings made of stainless steel have been formed primarily as straight wall tubes. In certain prior art food waste disposers including one marketed under the InSinkErator® brand as Model 555, the food conveying housing was formed as a stainless steel tube where the lower portion of the stainless steel tube which contained the stationary shredder ring was expanded to a slightly larger diameter than the upper portion. This created a small shoulder over the stationary shredder ring which served as a food deflecting feature. In another prior art food waste disposer disclosed in U.S. Pat. No. 7,360,729, the food conveying housing was formed as a stainless steel tube with a flange on the lower end. The stationary shredder ring was contained in a plastic adaptor ring that extended above the stationary shredder ring and incorporated a food deflecting overhang and bevel. The adaptor assembly and stainless steel tube were mated through a gasket and an external clamp ring. U.S. Pat. No. 7,607,599 discloses a food waste reduction mechanism for a food waste disposer that has a ledge that overhangs a periphery of a rotating shredder plate assembly of the grinding mechanism of a food waste disposer.

In a prior art food waste disposer marketed under the InSinkErator® brand as Model 77, the conveying housing, which was made of stainless steel, had a two-chamber body in which the upper portion or chamber had a significantly smaller diameter than the lower portion or chamber. The transition between the small diameter upper portion and the larger diameter lower portion had a curved or arch-like profile that served to deflect food back into the grinding mechanism. The food waste disposer having this food conveying housing was a highly-aggressive, fast grinding food waste disposer compared to food waste disposers where the body of the food conveying housing was a straight wall stainless steel tube. The disadvantage of the food conveying housing having this two-chamber body was that the volume of the food conveying housing was reduced compared to straight wall bodies. Also, certain components such as the body top and trim shells had to be redesigned to accommodate the smaller diameter upper chamber.

SUMMARY

This section provides a general summary of the disclosure, and is not a comprehensive disclosure of its full scope or all of its features.

In accordance with an aspect of the present disclosure, a food waste disposer has a food conveying section that receives food waste and water; a grinding section including a grinding mechanism, and a motor section including a motor. The grinding section is disposed between the food conveying section and the motor section. The grinding mechanism includes a stationary grind ring and a rotating shredder plate assembly that rotates in the grind ring to grind food waste to form ground matter that combines with the water to form a slurry. The slurry passes into a discharge area in an upper end bell below the shredder plate assembly. The food conveying section includes a housing having a food waste deflecting band with an angular profile at a lower end of the housing.

In an aspect, the food waste deflecting band includes diverters.

In an aspect, the diverters are projections that project downwardly from a lower sloped wall of the food waste deflecting band. In an aspect, the diverters are projections that project inwardly from a junction where upper and lower sloped walls of the food waste deflecting band meet.

In an aspect, the food deflecting band is discontinuous having a plurality of discontinuities spaced therearound which provide the diverters. In an aspect, the discontinuities are flattened sections of the food waste deflecting band wherein the lower sloped wall of the food waste deflecting band at each flattened section is flattened to provide a horizontally inwardly extending projection.

In an aspect, the food waste deflecting band is a continuous band.

In an aspect, the conveying housing is a conical wall housing and in an aspect, may be a plastic molded housing having the deflecting band integrally molded at a lower end thereof. In an aspect the deflecting band includes a plurality of diverters and in an aspect, each diverter includes a projection having a inwardly extending truncated triangular section and a downwardly extending truncated triangular section.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
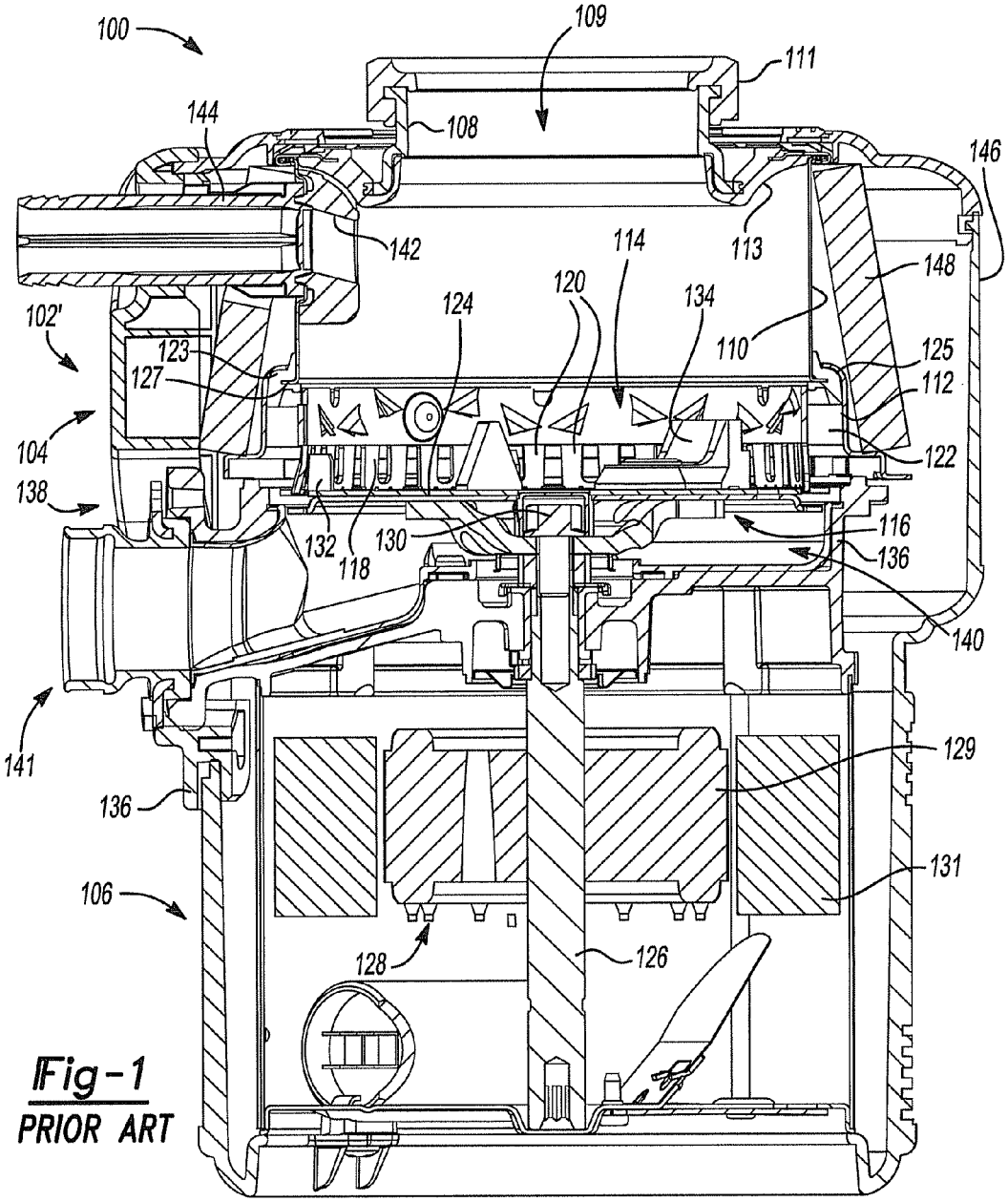
Fig-1 PRIOR ART
FIG. 1 shows a cross-sectional view of a prior art food waste disposer.

Example embodiments will now be described more fully with reference to the accompanying drawings. Corresponding reference numerals indicate corresponding parts throughout the several views of the drawings.

Figure 2:
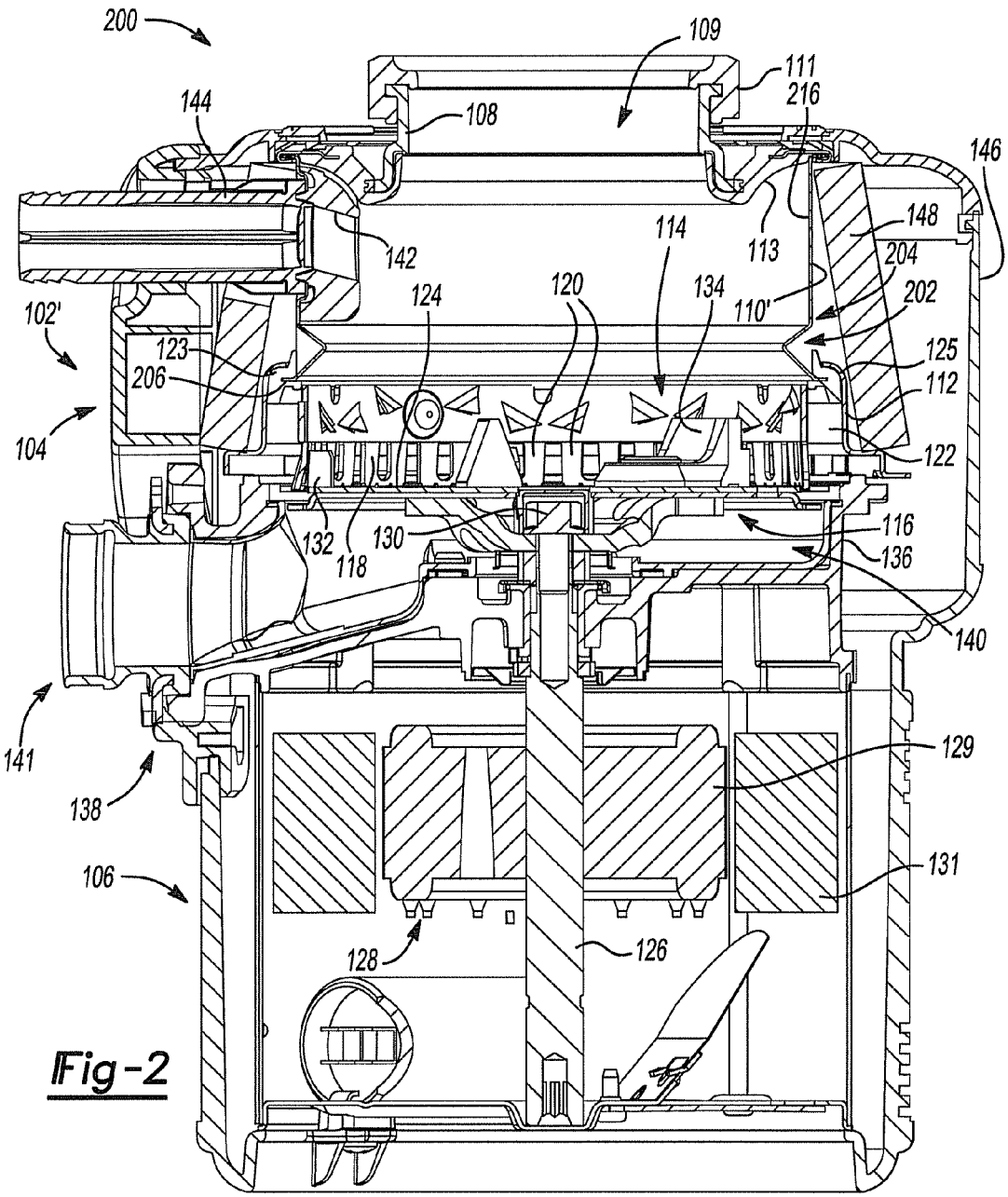
FIG. 2 shows a cross-sectional view of a food waste disposer having a food conveying housing having a straight cylindrical sidewall and a food waste deflecting band in a lower end thereof in accordance with an aspect of the present disclosure.

With reference to FIG. 2, in accordance with an aspect of the present disclosure, a food waste disposer 200 is shown where a lower end 204 of conveying housing 110' has a food deflecting band 202. Other than these differences, food waste disposer 200 is essentially the same as food waste disposer 100. The following discussion will thus focus on these differences which relate to conveying housing 110' of food conveying section 102' having food deflecting band 202. Conveying housing 110' may illustratively be a cylinder, such as a stainless steel tube, with food deflecting band at lower end 204.

Figure 3:
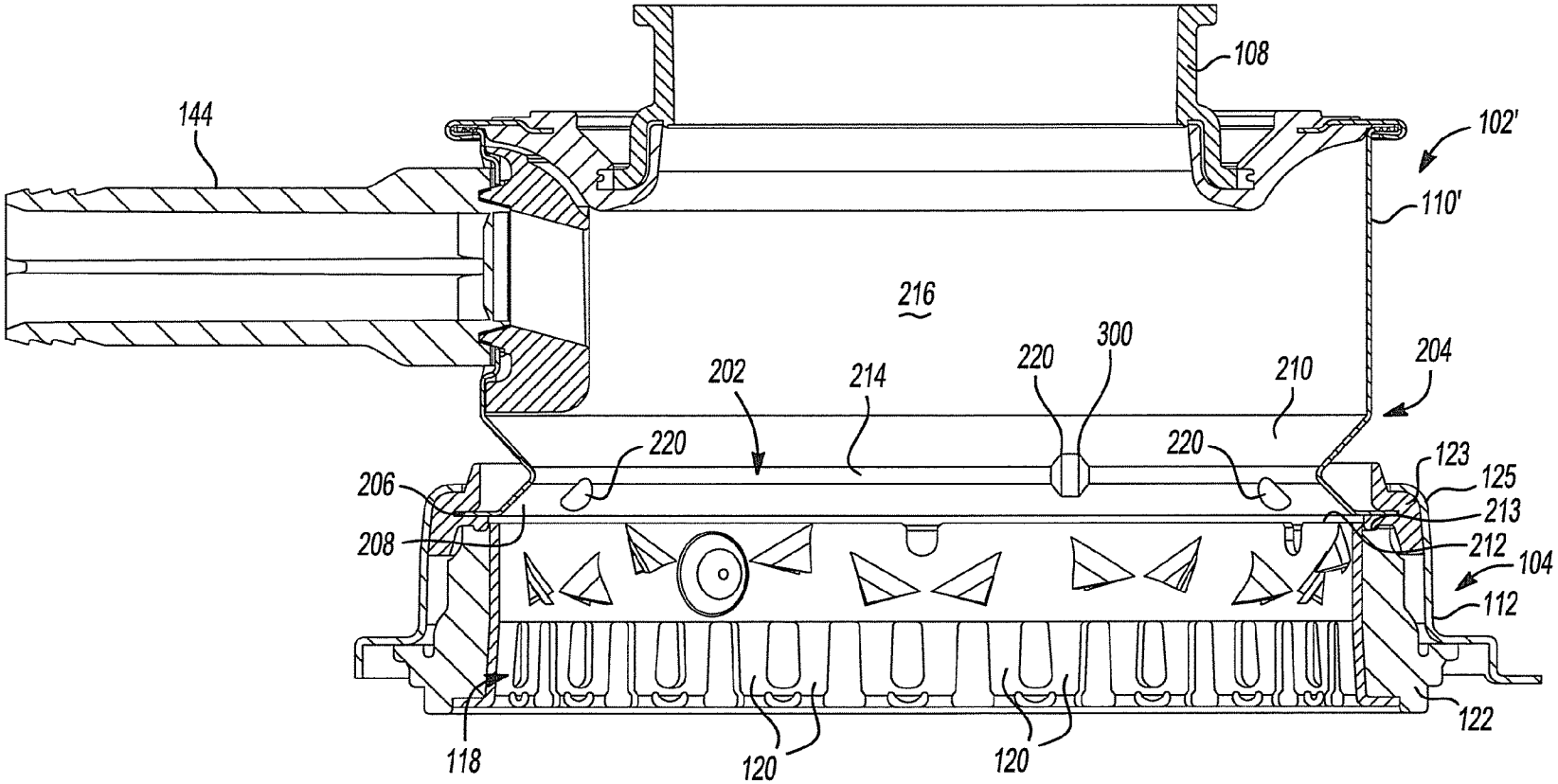
FIG. 3 is a cross-sectional perspective view of an upper portion of the food waste disposer of FIG. 2.

FIG. 3 is a cross-sectional perspective view of food conveying section 102' and grinding section 104, and shows in more detail food deflecting band 202 at the lower end 204 of conveying housing 110'. Food deflecting band 202 extends around conveying housing 110' at lower end 204 thereof. Food deflecting band 202 includes a bottom flange 206, a lower, sloped wall 208 and an upper wall 210. Bottom flange 206 extends over tops 212, 213, respectively, of stationary grind ring 118 and adaptor ring 122. Bottom flange 206 is captured between the tops 212, 213, respectively of stationary grind ring 118 and adaptor 122 (on the one hand) and gasket 123 abutting upper portion 125 of grinding section housing 112 on the other hand. In the illustrative embodiment shown in FIGS. 2 and 3, food waste deflecting band 202 is a continuous band extending around conveying housing 202. It should be understood that food waste deflecting band 202 may be discontinuous as discussed in more detail below.

Figure 4:
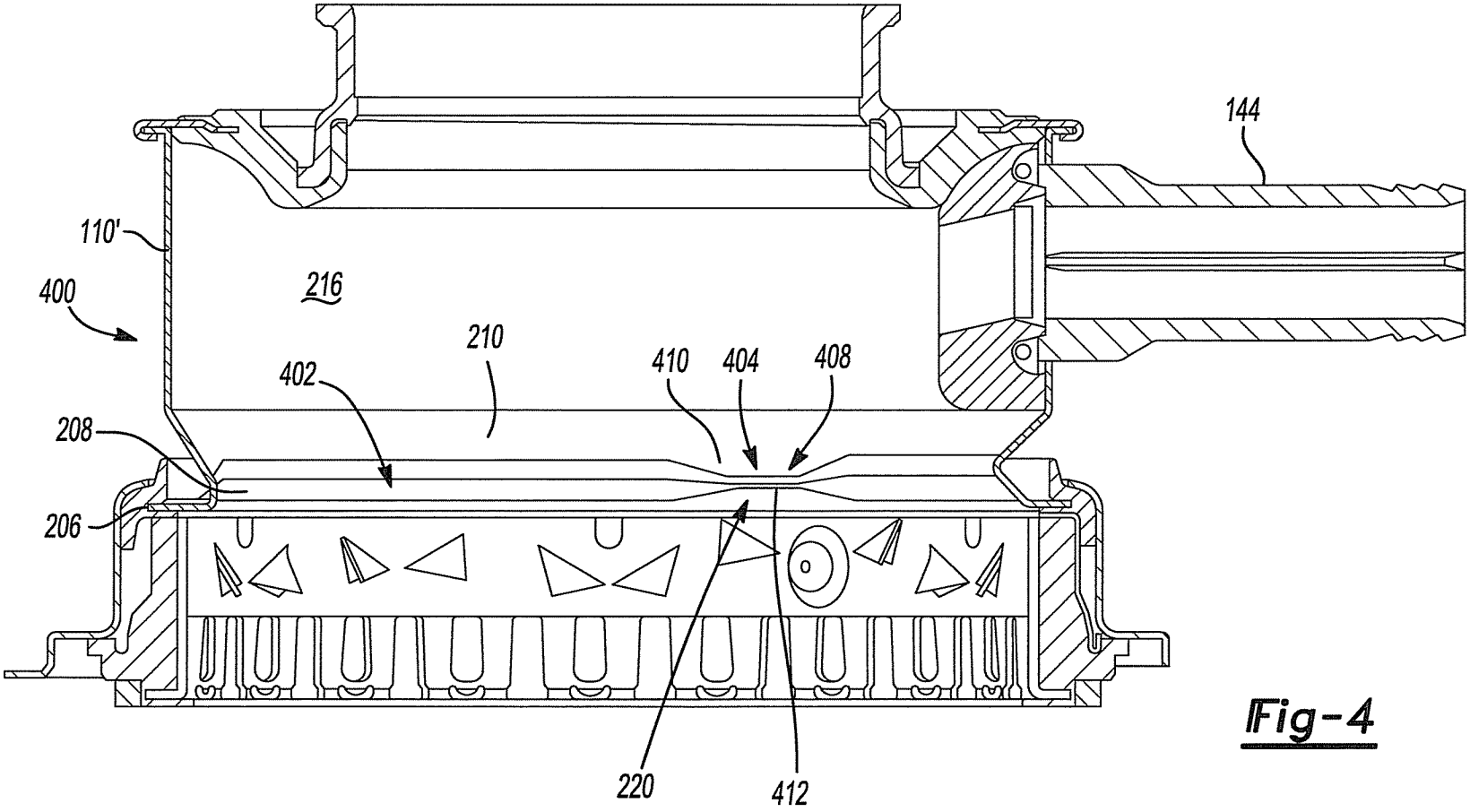
FIG. 4 is a cross-sectional view cross-sectional perspective view of an alternative upper portion for the food waste disposer of FIG. 2 having a discontinuous food waste deflecting band in accordance with an aspect of the present disclosure.

In the illustrative embodiment shown in FIGS. 2-4, lower sloped wall 208 is planar and has a slope that slopes with respect to sidewall 216 of conveying housing 110' from bottom flange 206 at an angle inwardly and upwardly. The angle is an angle at which food waste expelled upwardly by rotating shredder plate assembly 116 from generally the periphery thereof is deflected back down into the grinding section 104. It may illustratively be determined heuristically. It may, by way of example and not of limitation, be forty-five degrees. It should be understood that lower sloped wall 208 can have a shape that is other than planar. Its shape could for example be concave, convex or have other curvatures.

Lower sloped wall 208 and upper wall 210 meet at a junction 214, which is at radially inner ends of each of lower sloped wall 208 and upper wall 210. In this regard, reference number 214 also identifies the radially inner ends of lower sloped wall 208 and upper wall 210.

Upper wall 210 extends between junction 214 and straight cylindrical sidewall 216 of conveying housing 110'. In the illustrative example shown in FIGS. 2 and 3, upper wall 210 slopes upwardly and outwardly from junction 214 to cylindrical sidewall 216. Upper wall 210 may, for example, slope at the same angle as lower sloped wall 208. In this illustrative example, food deflecting band 202 is a V-shaped band with the point of the V, junction 214, the radially innermost part of food deflecting band 202. It should be understood, that upper wall 210 could slope at an angle other than the angle at which lower sloped wall 208 slopes, or could extend horizontally between junction 214 and cylindrical sidewall 216.

In operation when shredder plate assembly 116 is rotating, food waste that is expelled upwardly from grinding section 104 is reflected by food waste deflecting band 202 back to grinding mechanism 114 in grinding section 104. It should be understood that some of the food waste that is expelled upwardly from grinding section 104 may be expelled inwardly as well, and thus may not be reflected by food waste deflecting band 202. However, the expulsion of food waste upwardly from grinding section 104 is typically caused by the contact of the food waste against stationary grind ring 118 and thus it is expelled upwardly from a periphery of rotating shredder plate 124, such as along stationary grind ring 118. This food waste is thus likely to contact food waste deflecting band 202 and be reflected back into grinding section 104.

Food deflecting band 202 may optionally include diverters 220. Diverters 220 prevent food waste from riding on food deflecting band 202, particularly lower sloped wall 208, and helps it more rapidly tumble back into grinding section 104. "Riding" as that term is used in the art is where food waste spins but does not grind. In an aspect, diverters 220 may illustratively be projections that project downwardly from lower sloped wall 208 and may be formed in lower sloped wall 208, such as dimples, truncated triangular members, or other projecting members. Diverters 220 may alternatively be members attached to lower sloped wall 208. In an illustrative aspect, lower sloped wall 208 includes three diverters 220 spaced equidistantly around food deflecting band 202. It should be understood that food deflecting band 202 can have more or fewer than three diverters 220, or none at all. It should also be understood that diverters 220 could additionally or alternatively be projections that project inwardly from junction 214, such as projection 300 shown in FIG. 3. Diverters 220 could be integrally formed as part of food deflecting band 202, or be affixed to food deflecting band 202. Diverters 220 could by way of example and not of limitation when conveying housing 110' is a molded plastic housing, be integrally molded with conveying housing 110', and in an aspect, may be a metal cladded. Diverters 220 could also be, by way of example and not of limitation, stamped or cast metal parts, molded plastic parts, or metal reinforced molded plastic parts.

Figure 5:
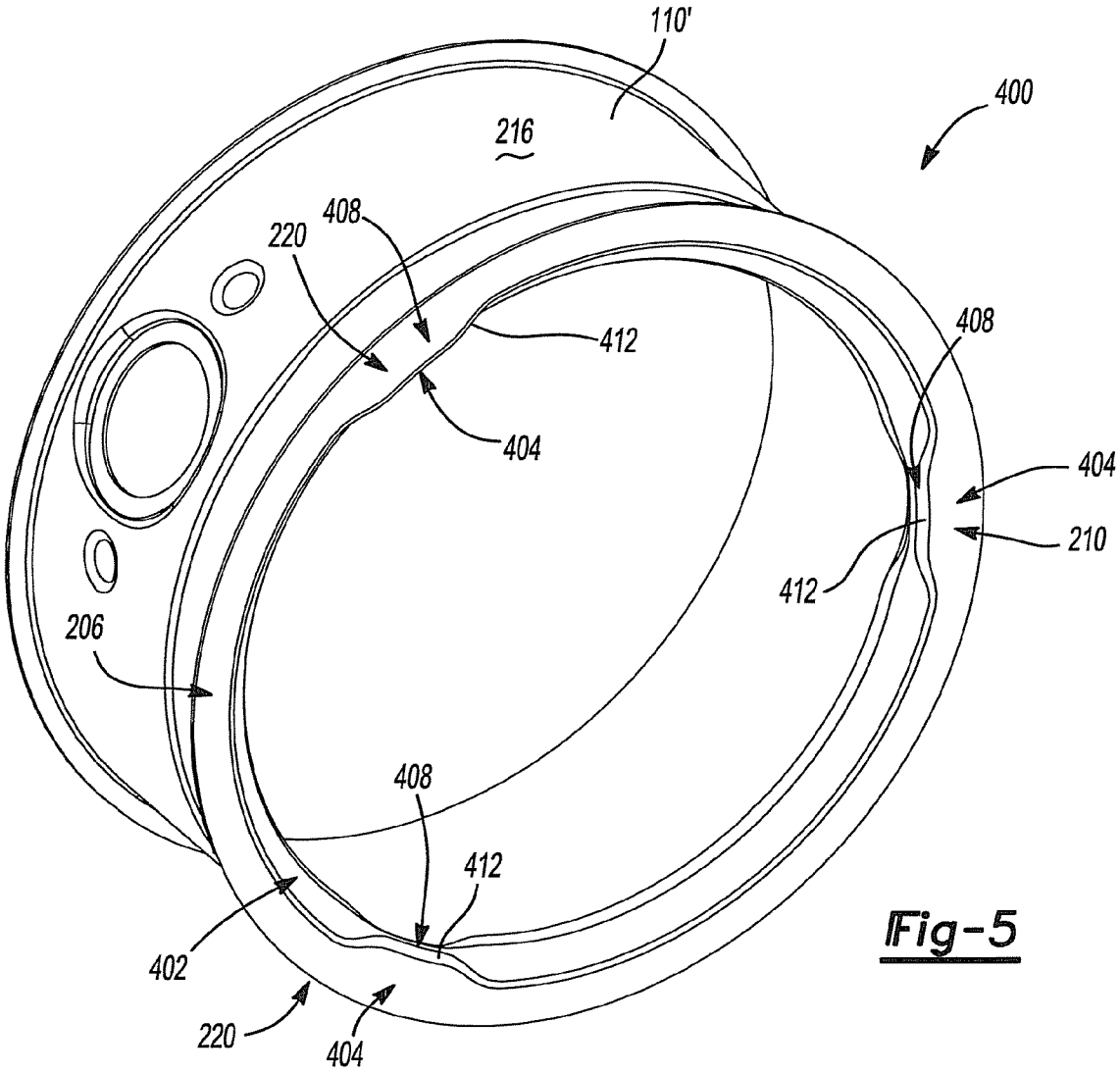
FIG. 5 is a bottom perspective view of the upper portion of FIG. 4.

In an aspect, the food waste deflecting band may be discontinuous with the diverters 220 being provided by discontinuities in the food waste deflecting band. FIG. 4 is a cross-sectional perspective view of a food conveying section 400 having a discontinuous food deflecting band 402 and FIG. 5 is a bottom view of food conveying section 400 (but without dishwasher inlet 144 being shown). Food conveying section 400 is the same as food conveying section 102' other than discontinuous food deflecting band 402. Discontinuous food waste deflecting band 402 has a plurality of discontinuities 404 therein spaced around food deflecting band 402, only one of which is shown in FIG. 4. In the aspect shown in FIGS. 4 and 5, each discontinuity 400 is a flattened section 408 of the food waste deflecting band 402 that in an aspect, is formed by an indentation 410 in upper wall 210 and a corresponding inwardly extending horizontal projection 412 in lower sloped wall 208 immediately beneath indentation 410. The term "horizontal" is used in this context with reference to the orientation of projection 412 when food waste disposer 200 is mounted to a sink. In this regard, horizontal projection 412 may in effect be an inward extension or projection of bottom flange 206. It should be understood that horizontal projection 412 can have a slight angle with respect to horizontal and the term horizontal projection in this context includes a projection that has a slight angle with respect to horizontal as well as a projection that is horizontal. Discontinuous food deflecting band 402 may in an aspect have three discontinuities 404 and may in an aspect have four discontinuities 404. It should be understood that discontinuous food deflecting band 402 may have other than three or four discontinuities 404. Each discontinuity 404 may be ⅝ of an inch wide. It should be understood however, that each discontinuity 404 may have a width other than ⅝ of an inch. In an aspect, discontinuous food waste deflecting band 402 may also include projections that provide diverters 220 in addition to discontinuities 404.

In the illustrative embodiments shown in FIGS. 2-5, conveying housing 110' is formed of stainless steel and food deflecting band 202, 202' formed as an integral part thereof. It should be understood that food conveying housing 110' could also be die cast metal (such as aluminum, magnesium, zinc or other die castable metals) or molded of plastic. It should also be understood that food deflecting band 202, 402 could be a plastic or metal insert affixed to cylindrical sidewall 216 of food conveying housing 110' at a bottom thereof.

Figure 6:
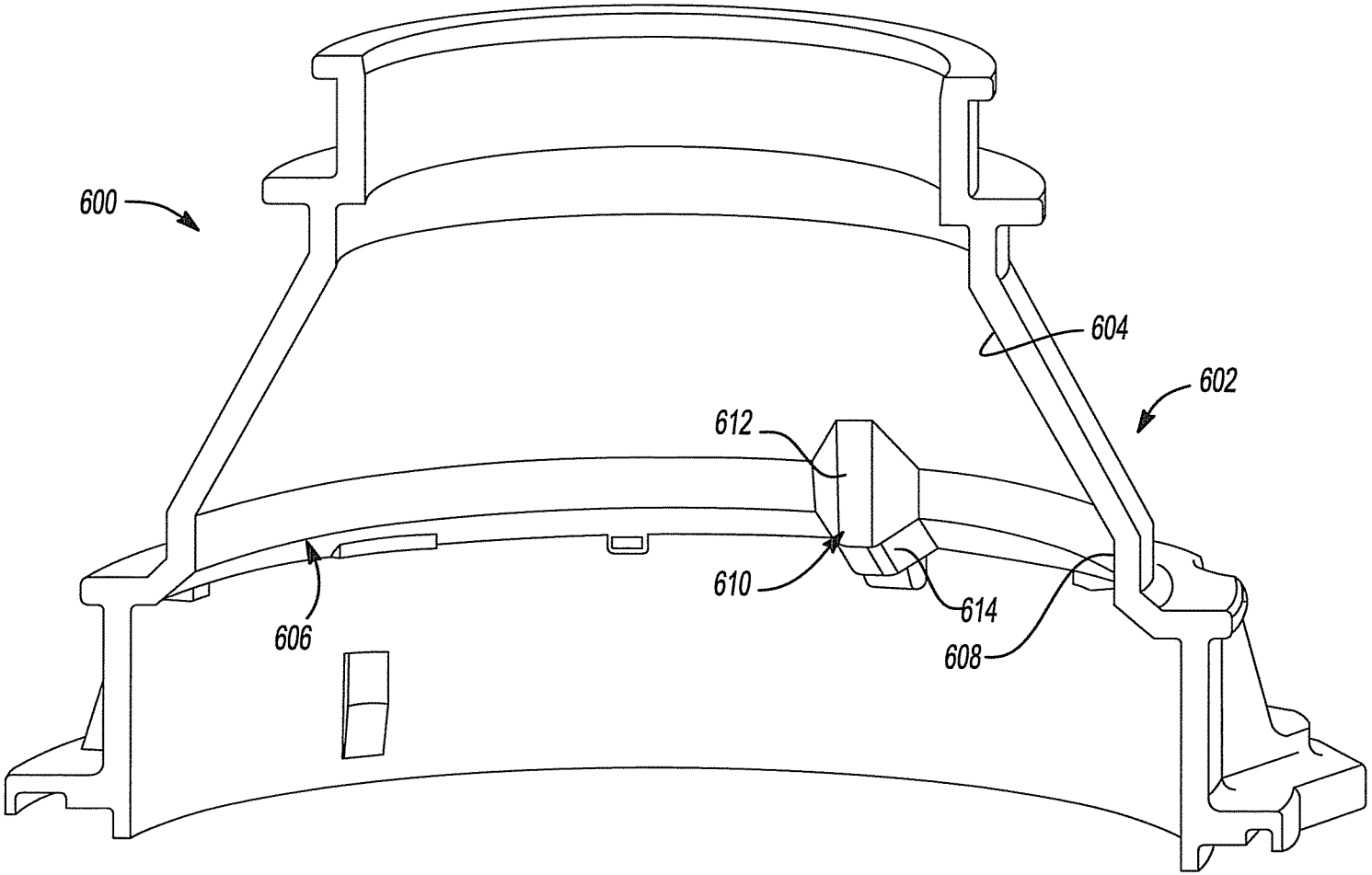
FIG. 6 is a cross-section perspective view of an upper portion of a food waste disposer having a food conveying section with a housing having a conical sidewall and a food deflecting band in a lower end thereof in accordance with an aspect of the present disclosure.

While conveying housing 110' in the embodiment shown in FIGS. 2 and 4 has a straight, vertical cylindrical sidewall 216, it should be understood that the conveying housing could have a conical or curved sidewall. The term "vertical" is used in this context with reference to the orientation of sidewall 216 when food waste disposer 200 is mounted to a sink. FIG. 6 shows a sectional view of food conveying section 600 having a conveying housing 602 having a conical sidewall 604 with food waste deflecting band 606 extending therearound at a lower end 608 of conical sidewall 604. Food waste deflecting band 606 may optionally include diverters 610 spaced around it (only one of which is shown in FIG. 6) Diverters 610 in the embodiment shown in FIG. 6 have an inwardly projecting truncated triangular section 612 and a downwardly projecting truncated triangular section 614. In should be understood that diverters 610 can have other shapes.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A food waste disposer, comprising:

a food conveying section that receives food waste and water;

a motor section including a motor;

a grinding section that receives food waste and water from the food conveying section, the grinding section including a grinding mechanism, the grinding mechanism including a stationary grind ring and a rotating shredder plate assembly that rotates in the stationary grind ring, the rotating shredder plate assembly rotated by the motor; and the food conveying section including a housing having a food waste deflecting band at a lower end of the housing adjacent the grinding mechanism, the food waste deflecting band having an angular profile with a lower sloped wall that slopes upwardly and inwardly with respect to a sidewall of the housing.

2. The food waste disposer of claim 1, wherein the food waste deflecting band includes a plurality of diverters.

3. The food waste disposer of claim 2 wherein the diverters are projections that project downwardly from a lower sloped wall of the food waste deflecting band.

4. The food waste disposer of claim 2 wherein the diverters are projections that project inwardly from a junction where upper and lower sloped walls of the food waste deflecting band meet.

5. The food waste disposer of claim 2 wherein the diverters are discontinuities in the food waste deflecting band.

6. The food waste disposer of claim 5 wherein the discontinuities are flattened sections of the food waste deflecting band wherein the lower sloped wall of the food waste deflecting band at each flattened section is flattened to provide a horizontally inwardly extending projection.

7. The food waste disposer of claim 1 wherein the food waste deflecting band is a continuous food waste deflecting band.

8. The food waste disposer of claim 1 wherein the housing of the food conveying section is cylindrical.

9. The food waste disposer of claim 1 wherein the housing of the food conveying section is conical.

10. The food waste disposer of claim 9 wherein the food waste deflecting band includes a plurality of diverters.

11. The food waste disposer of claim 10 wherein each diverter includes a projection having a inwardly extending truncated triangular section and a downwardly extending truncated triangular section.

12. The food waste disposer of claim 10 wherein the lower sloped wall of the food waste deflecting band slopes upwardly and inwardly from a bottom flange of the food waste deflecting band.

13. The food waste disposer of claim 12 wherein the bottom flange extends over tops of the stationary grind ring and an adaptor ring in which the stationary grind ring is received.

14. The food waste disposer of claim 12 wherein the food waste deflecting band includes an upper sloped wall, the upper and lower sloped walls meeting at a junction of radially inner ends thereof, the upper sloped wall sloping upwardly and outwardly from the junction where it meets the lower sloped wall.

* * * * *